US011686297B1

(12) United States Patent
Gu

(10) Patent No.: US 11,686,297 B1
(45) Date of Patent: Jun. 27, 2023

(54) ELECTRIC OIL PUMP WITH ONE-WAY VALVE

(71) Applicant: Zhongshan Jitonglong Plastic Hardware Products Co., Ltd, Zhongshan (CN)

(72) Inventor: Xinguo Gu, Zhongshan (CN)

( * ) Notice: Subject to any disclaimer, the term of this patent is extended or adjusted under 35 U.S.C. 154(b) by 0 days.

(21) Appl. No.: 18/079,727

(22) Filed: Dec. 12, 2022

(30) Foreign Application Priority Data

Nov. 4, 2022 (CN) ..... 202222938387.8

(51) Int. Cl.
*F04B 15/02* (2006.01)
*F04B 23/02* (2006.01)
*B67D 7/32* (2010.01)

(52) U.S. Cl.
CPC ..... *F04B 15/02* (2013.01); *B67D 7/3227* (2013.01); *F04B 23/021* (2013.01)

(58) Field of Classification Search
CPC ..... F04B 15/00; F04B 15/02; F04B 17/03; F04B 19/04; F04B 23/00; F04B 23/02; F04B 23/021; F04B 53/10; F04B 53/1002; F04B 53/101; F04B 53/1017; F04D 13/08; F04D 13/086; F04D 15/0083; F04D 27/009; F04D 29/08; F04D 29/086; B67D 7/68; B67D 7/3227; B67D 3/044–048; F16K 15/04; F16K 15/048; F16K 15/148; F16K 17/19; F16K 24/00
See application file for complete search history.

(56) References Cited

U.S. PATENT DOCUMENTS 8,382,454 B2 * 2/2013 Aso ..... F16K 15/04 417/415
D723,587 S * 3/2015 Park ..... D15/7
2018/0265345 A1 * 9/2018 Marshall ..... B67D 7/0294
2021/0156389 A1 * 5/2021 Park ..... F04D 13/068

FOREIGN PATENT DOCUMENTS

CN 109973688 A 7/2019
CN 215623809 U 1/2022

OTHER PUBLICATIONS

Author: Tera Pump Title: Electric Drum Pump Date published in view of U.S. Pat. No. D. 723,5587S: Mar. 3, 2015 Date accessed: Mar. 3, 2023 Link:https://econtent.adhq.com/dam/Original/10000/Tera_Pump_TREDRUMT_Manual.pdf (Year: 2015).*

* cited by examiner

*Primary Examiner* — Charles G Freay
*Assistant Examiner* — Chirag Jariwala

(57) ABSTRACT

An electric oil pump with an one-way valve is provided, which includes a control box. The control box is provided with a communication pipe and a control board, one end of the communication pipe is connected with an oil-extracting pipe, the other end is connected with an oil outlet pipe, a pump body is arranged in the oil outlet pipe, and a bottom of the control box is rotatably installed with a threaded cap. When the oil pump is, working, the gasoline is blocked by the one-way valve and transported to the oil outlet pipe via the oil-extracting pipe during the oil delivery process, and the negative pressure in the oil drum makes the outside air enter into the oil drum through the one-way valve when the oil pumping is completed, so as to maintain the pressure balance between the inside and outside of the oil drum.

7 Claims, 5 Drawing Sheets

ELECTRIC OIL PUMP WITH ONE-WAY VALVE

TECHNICAL FIELD

The present disclosure relates to an oil pump, in particular to an electric oil pump with an one-way valve.

BACKGROUND

The existing household electric oil pump includes an oil-extracting pipe, an oil outlet pipe and a control box connecting the two pipes. When in use, the oil-extracting pipe is inserted into the oil drum, fixed with the oil outlet of the oil drum through the threaded cap on the control box, and the oil is pumped out by the operation of the oil pump on the oil-extracting pipe after the switch is turned on. The threaded cap and the oil outlet thread of the oil drum are fixed and sealed, but the pressure in the oil drum changes during the oil pumping process, which is easy to lead to the deformation of the oil drum. In order to balance the internal and external pressure of the oil drum, an air outlet communicated with the interior of the oil drum is usually set on the control box. However, gasoline is easily ejected from the air outlet and drips out of the control box in the process of pumping, which not only easily causes damage to the inside of the control box, but also increases potential safety hazards.

SUMMARY

In order to overcome the shortcomings of the prior art, the present disclosure provides an electric oil pump with one-way valve.

The technical solution adopted by the present disclosure to solve the above technical problems is as following:

An electric oil pump with an one-way valve, including a control box, the control box is provided with a communication pipe and a control board, one end of the communication pipe is connected with an oil-extracting pipe, the other end of the communication pipe is connected with an oil outlet pipe, a pump body electrically connected with the control board is arranged in the oil-extracting pipe, and a bottom of the control box is rotatably installed with a threaded cap, wherein the control box is provided with an air inlet communicated with the communication pipe and an air inlet pipe communicated with the bottom of the control box; an outside of the air inlet is sleeved with a valve body, an upper end of the valve body is provided with an air inlet cavity, an lower end of the valve body is provided with an air outlet cavity, and a communication channel is arranged between the air inlet cavity and the air outlet cavity; the air inlet cavity is equipped with a valve cover, the valve cover is provided with a plurality of air inlet holes, a bottom of the valve cover corresponding to a position of the air inlet holes is provided with a sealing film, and the air outlet cavity is movably equipped with a sealing ball to block an opening of the communication channel.

The present disclosure has the advantageous effects that: the one-way valve is installed on the air inlet of the control box, and the control box is provided with an air inlet pipe, the air inlet pipe is communicated with the air of the oil drum after the threaded cap is installed in the oil drum; when the oil pump is working, the gasoline is blocked by the one-way valve and transported to the oil outlet pipe via the oil-extracting pipe during the oil delivery process, and the negative pressure in the oil drum makes the outside air enter the oil drum through the one-way valve when the oil pumping is completed, so as to maintain the pressure balance between the inside and outside of the oil drum.

BRIEF DESCRIPTION OF THE DRAWINGS

The present disclosure is further described below in combination with the drawings and embodiments.

DETAILED DESCRIPTION OF THE EMBODIMENTS

Figure 1:
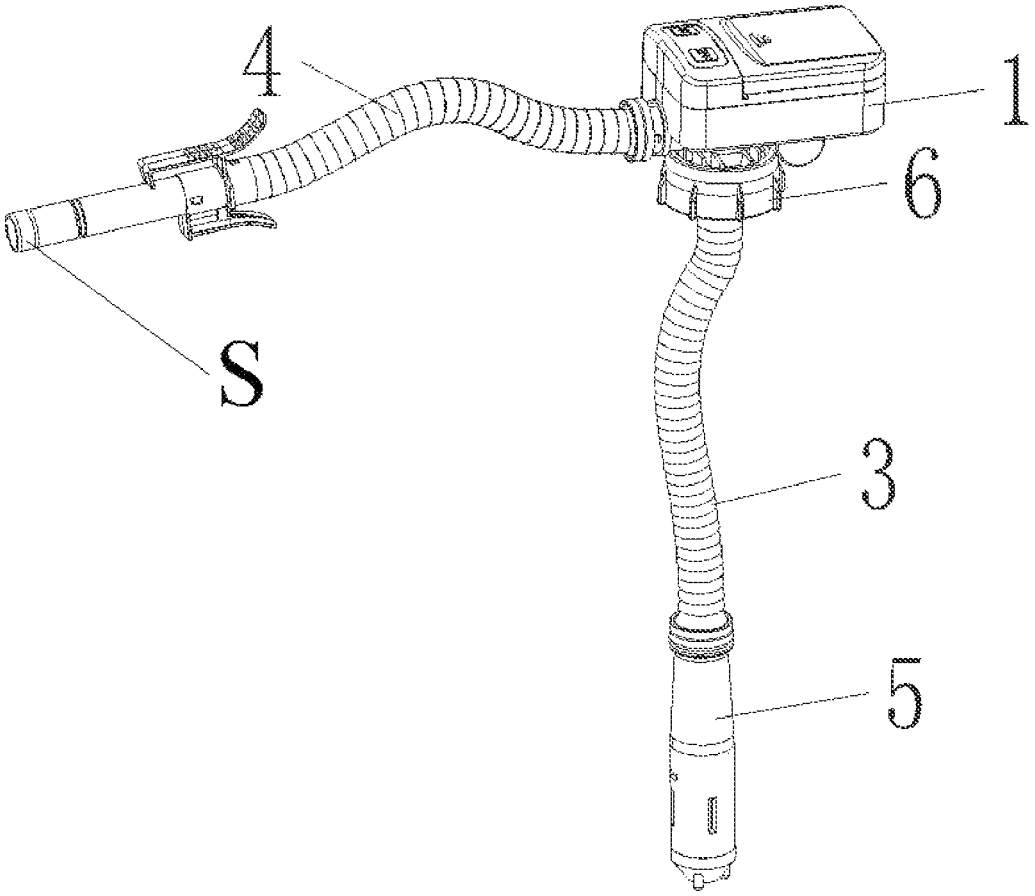
FIG. 1 is a structural diagram of the electric oil pump.
Figure 2:
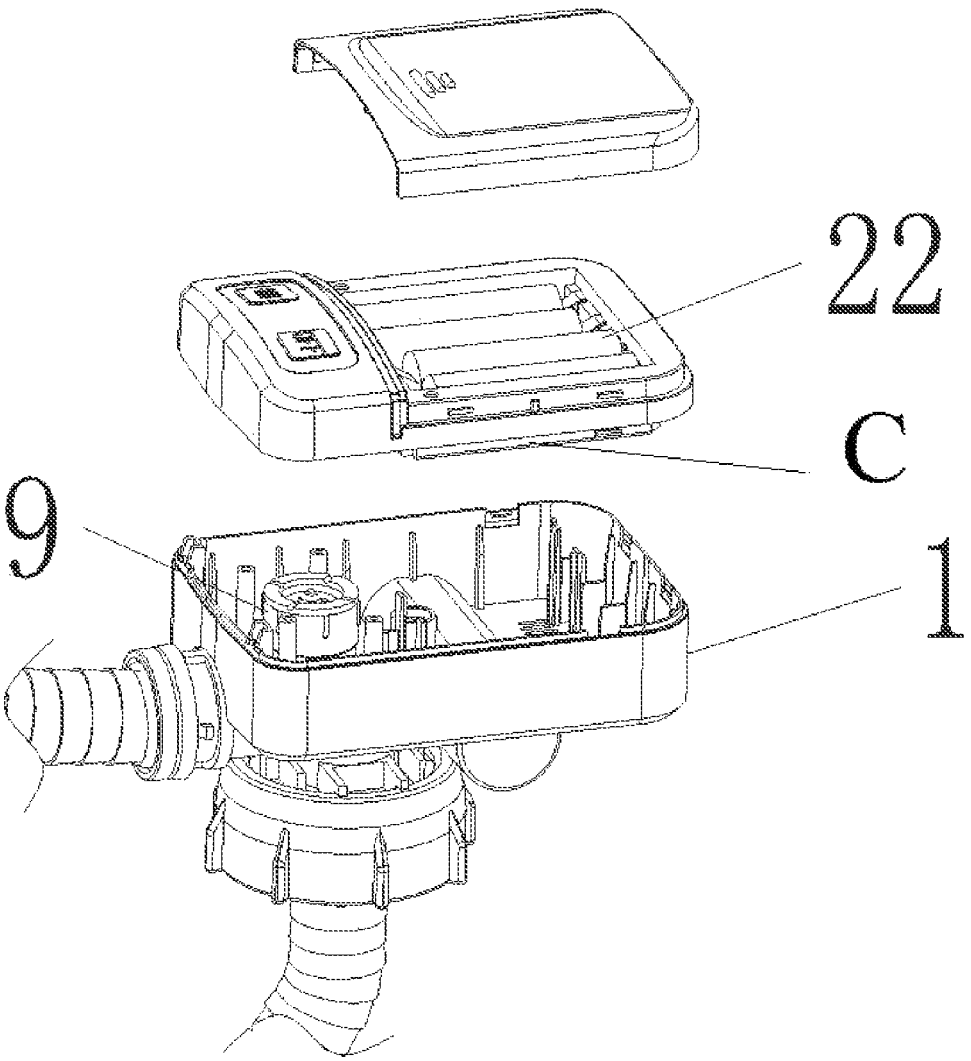
FIG. 2 is an exploded view of the electric oil pump.
Figure 3:
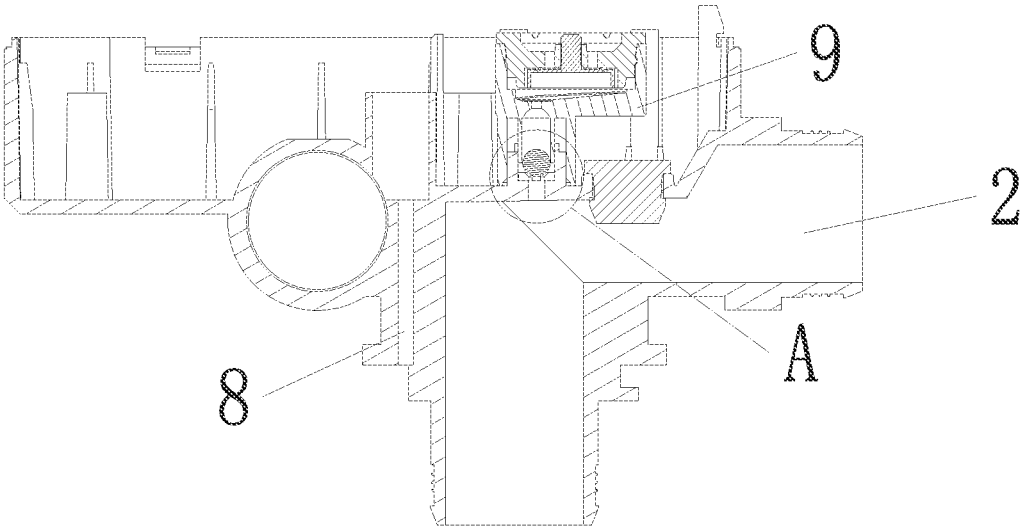
FIG. 3 is a sectional diagram of the control box.
Figure 4:
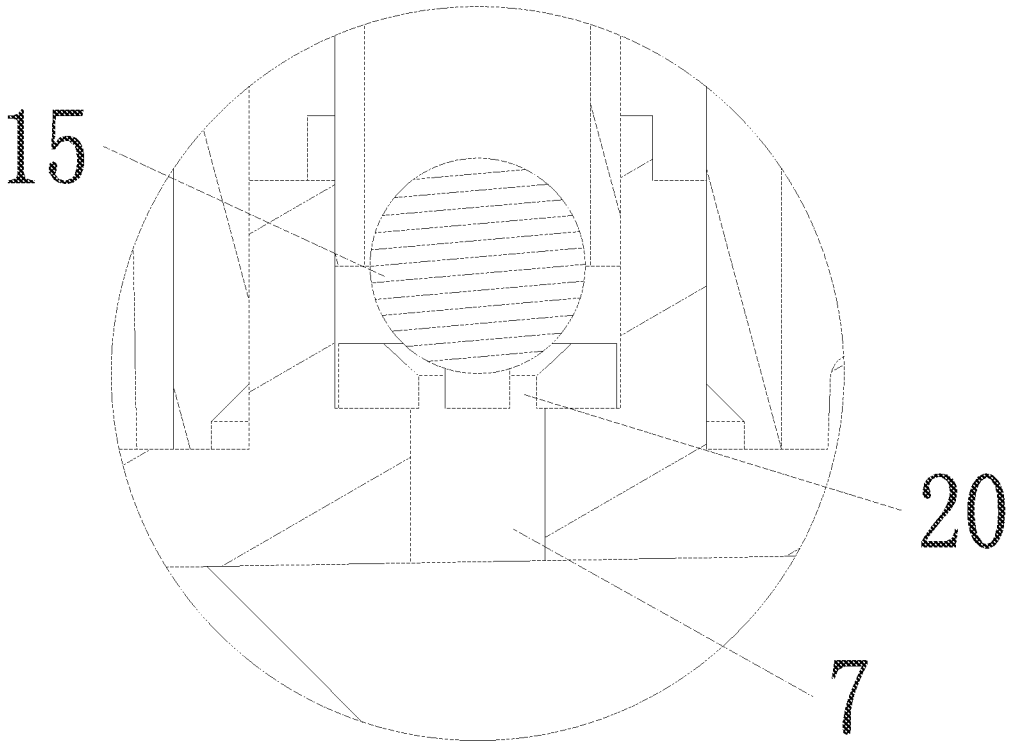
FIG. 4 is an enlarged partial view showing of portion A in FIG. 3.
Figure 5:
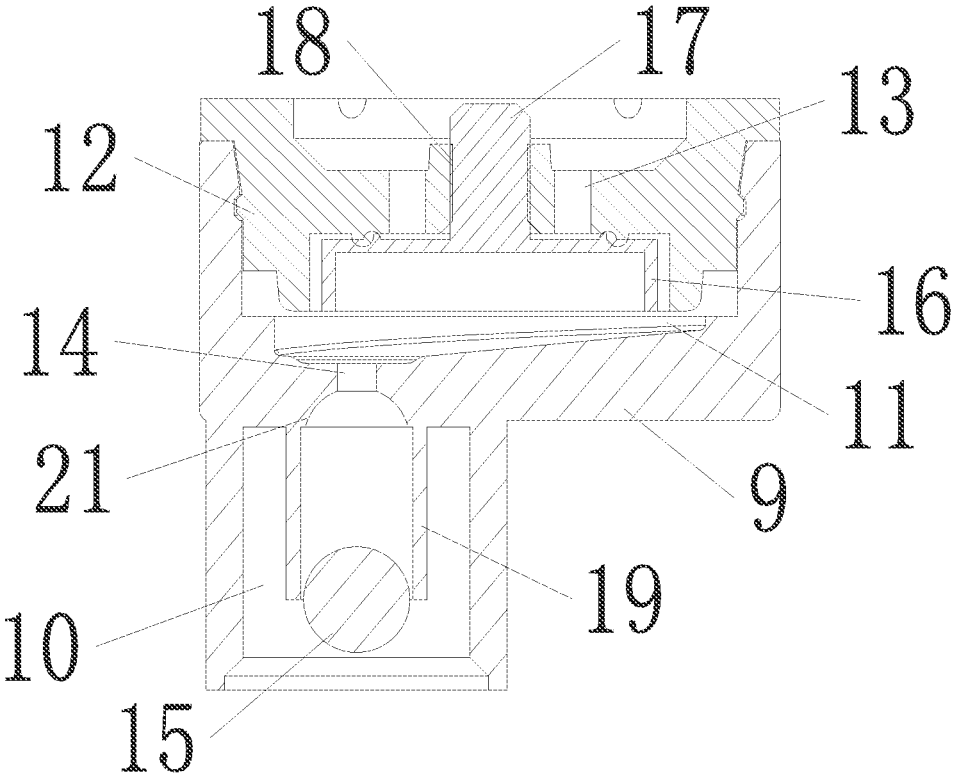
FIG. 5 is a sectional diagram of the one-way valve.

Referring to FIG. 1 to FIG. 5, an electric oil pump with an one-way valve is provided, which includes a control box 1, and the control box 1 is provided with a communication pipe 2 and a control board C. One end of the communication pipe 2 is connected with an oil-extracting pipe 3, and the other end of the communication pipe 2 is connected with an oil outlet pipe 4. A pump body 5 electrically connected with the control board C is arranged in the oil-extracting pipe 3, and the bottom of the control box 1 is rotatably installed with a threaded cap 6. The control box 1 is provided with an air inlet 7 communicated with the communication pipe 2 and an air inlet pipe 8 communicated with the bottom of the control box 1. The outside of the air inlet 7 is sleeved with a valve body 9, the upper end of the valve body 9 is provided with an air inlet cavity 11, the lower end of the valve body 9 is provided with an air outlet cavity 10, and a communication channel 14 is arranged between the air inlet cavity 11 and the air outlet cavity 10. The air inlet cavity 11 is equipped with a valve cover 12, the valve cover 12 is provided with a plurality of air inlet holes 13, the bottom of the valve cover 12 corresponding to the position of the air inlet holes 13 is provided with a sealing film 16, and the air outlet cavity 10 is movably equipped with a sealing ball 15 to block the opening of the communication channel 14. The one-way valve is installed on the air inlet of the control box, and the control box is provided with an air inlet pipe communicated with the outside. When the oil pump is working, the gasoline is blocked by the one-way valve and transported to the oil outlet pipe via the oil-extracting pipe during the oil delivery process, and the negative pressure in the oil drum makes the outside air enter into the oil drum through the one-way valve when the oil pumping is completed, so as to maintain the pressure balance between the inside and outside of the oil drum. The specific principle is that during the working process of the oil pump, the gasoline enters into the air outlet cavity and pushes the sealing ball upward until the communication channel is blocked. Even if the gasoline passes through the communication channel, a double seal can be formed with the sealing film described above to prevent the gasoline from flowing out of the valve body.

There is a gap between the sealing film 16 and the bottom of the valve cover 12, the bottom of the valve cover 12 is provided with a first stop ring, and the top of the sealing film 16 is provided with a second stop ring. When the air passes through the air inlet holes, the air drives the sealing film to deform, enters into the valve body through the gap between the sealing film and the valve cover, and then enters into the oil drum to balance the internal and external pressure. However, when the gasoline enters the air inlet cavity, the sealing film is reset to block the air inlet holes. Since the gasoline density is far greater than the air density, the gasoline flow is blocked by the first stop ring and the second stop ring, so that the gasoline is not easy to flow out of the gap.

The top of the sealing film 16 is provided with a connecting boss 17, the valve cover 12 is provided with a mounting hole 18, and the connecting boss 17 is fixedly arranged in the mounting hole 18, such structure is stable and reliable.

The air outlet cavity 10 is provided with a sliding pipe 19, the sealing ball 15 is movably arranged in the sliding pipe 19, in this embodiment, the diameter of the sealing ball 15 is smaller than that of the sliding pipe 19, with a difference of 0.1-1 mm. The sliding pipe 19 is arranged on the inner side of the air inlet 7 after assembly.

The top of the air inlet 7 is provided with an air inlet notch 20, and the bottom of the communication channel 14 is provided with a spherical opening 21 matching the sealing ball 15. The air inlet notch can ensure that the outside air enters into the oil drum through the air inlet, and the spherical opening matches with the sealing ball 15 to play a sealing role. In this embodiment, the sealing ball 15 can be made of silica gel or metal materials.

The control box 1 is provided with a battery cavity 22 electrically connected with the control board C. Lithium battery can be installed in the battery cavity to provide low voltage direct current, which is simple to use, safe and convenient to replace.

An infrared sensor S electrically connected with the control board C is arranged in the end of the oil outlet pipe 4. The infrared sensor S can sense the liquid level inside the oil drum and send a signal to the control board C to control the oil pump to stop.

What is claimed is:

1. An electric oil pump with an one-way valve, comprising: a control box (1), the control box (1) is provided with a communication pipe (2) and a control board (C), one end of the communication pipe (2) is connected with an oil-extracting pipe (3), an other end of the communication pipe (2) is connected with an oil outlet pipe (4), a pump body (5) electrically connected with the control board (C) is arranged in the oil-extracting pipe (3), and a bottom of the control box (1) is rotatably installed with a threaded cap (6), wherein the control box (1) is provided with an air inlet (7) communicated with the communication pipe (2) and an air inlet pipe (8) communicated with the bottom of the control box (1); an outside of the air inlet (7) is sleeved with a valve body (9), an upper end of the valve body (9) is provided with an air inlet cavity (11), a lower end of the valve body (9) is provided with an air outlet cavity (10), and a communication channel (14) is arranged between the air inlet cavity (11) and the air outlet cavity (10); the air inlet cavity (11) is equipped with a valve cover (12), the valve cover (12) is provided with a plurality of air inlet holes (13), a bottom of the valve cover (12) corresponding to a position of the air inlet holes (13) is provided with a sealing film (16), and the air outlet cavity (10) is movably equipped with a sealing ball (15) to block an opening of the communication channel (14).

2. The electric oil pump with the one-way valve according to claim 1, wherein there is a gap between the sealing film (16) and the bottom of the valve cover (12).

3. The electric oil pump with the one-way valve according to claim 1, wherein a top of the sealing film (16) is provided with a connecting boss (17), the valve cover (12) is provided with a mounting hole (18), and the connecting boss (17) is fixedly arranged in the mounting hole (18).

4. The electric oil pump with the one-way valve according to claim 1, wherein the air outlet cavity (10) is provided with a sliding pipe (19), the sealing ball (15) is movably arranged in the sliding pipe (19), and the sliding pipe (19) is arranged on an inner side of the air inlet (7) after assembly.

5. The electric oil pump with the one-way valve according to claim 1, wherein a top of the air inlet (7) is provided with an air inlet notch (20), and a bottom of the communication channel (14) is provided with a spherical opening (21) matching the sealing ball (15).

6. The electric oil pump with the one-way valve according to claim 1, wherein the control box (1) is provided with a battery cavity (22) electrically connected with the control board (C).

7. The electric oil pump with the one-way valve according to claim 1, wherein an infrared sensor (S) electrically connected with the control board (C) is arranged in an end of the oil outlet pipe (4).

* * * * *